United States Patent [19]

Lu

[11] Patent Number: 5,048,596

[45] Date of Patent: Sep. 17, 1991

[54] OIL COOLER

[75] Inventor: James W. B. Lu, W. Bloomfield, Mich.

[73] Assignee: McCord Heat Transfer Corporation, Walled Lake, Mich.

[21] Appl. No.: 639,078

[22] Filed: Jan. 9, 1991

Related U.S. Application Data

[63] Continuation-in-part of Ser. No. 467,999, Jan. 2, 1990, abandoned.

[51] Int. Cl.[5] ..... F28F 9/02; F01M 5/00; F01P 11/08

[52] U.S. Cl. ..... 165/41; 165/51; 165/76; 165/158; 165/159; 165/916; 123/196 AB; 123/41.33; 184/104.3

[58] Field of Search ..... 165/41, 51, 119, 158, 165/159, 916, 76, 173; 123/196 AB, 41.33; 285/242; 184/104.3

[56] References Cited

U.S. PATENT DOCUMENTS

| | | | |
|---|---|---|---|
| 2,811,337 | 10/1957 | Andresen | 165/159 |
| 2,956,704 | 10/1960 | Boni, Jr. | 165/76 |
| 3,802,499 | 4/1974 | Garcea | 165/159 |
| 3,830,289 | 8/1974 | Olson | 165/51 |
| 3,863,713 | 2/1975 | Tramontini | 165/158 |
| 4,047,563 | 9/1977 | Kurata | 165/158 |
| 4,049,048 | 9/1977 | Leedham | 165/159 |
| 4,321,911 | 3/1982 | Offutt | 285/242 |
| 4,324,213 | 4/1982 | Kasting et al. | 165/51 |
| 4,589,478 | 5/1986 | Wunder | 165/158 |
| 4,821,795 | 4/1989 | Lu | 165/161 |

FOREIGN PATENT DOCUMENTS

| | | | |
|---|---|---|---|
| 0032224 | 7/1981 | European Pat. Off. | 165/916 |

*Primary Examiner*—John K. Ford

*Attorney, Agent, or Firm*—Reising, Ethington, Barnard, Perry & Milton

[57] ABSTRACT

A heat exchanger of the tube-fin type comprising a tank (10) having first (14) and second (16) ends, a plurality of tubes (34), a plurality of baffles (38) and a plurality of fins (42). A cap (50, 52) is connected to each end (14, 16) of the tank (10) and includes a fluid coupler (60, 61). Each cap (50, 52) comprises a female member (74) disposed therein including a plurality of interior passageways (88), first (90) and second (92) annular channels intersecting with opposite ends of the passageways (88), and a plurality of islands (94) bounded by the passageways (88) and first (90) and second (92) channels. The tank (10) further comprises a male member (72) extending from each end (14, 16) and including a plurality of outwardly extending tabs (76), an annular extending rim (82), and an annular resilient seal (84). A cap (50, 52) is disposed about each end (14, 16) of the tank (10) by inserting the tabs (76) into the longitudinal passageways (88) and extending the cap (50, 52) about the tank (10) until the tabs (76) intersect with the second channel (92) and rotated block the cap (50, 52) and the tank end (14, 16) together.

19 Claims, 5 Drawing Sheets

OIL COOLER

This is a continuation-in-part of copending application Ser. No. 467,999 filed on Jan. 2, 1990, now abandoned.

TECHNICAL FIELD

The subject invention relates generally to heat exchangers and, more specifically, to the connection of the inlet and outlet of an oil cooler to fixed parts of an engine.

BACKGROUND ART

Heat exchangers are often used as automobile oil coolers for maintaining the viscosity characteristics of the oil as it circulates throughout the engine components. U.S. Pat. No. 4,324,213 to Kasting et al, issued Apr. 13, 1982 and U.S. Pat. No. 4,821,795 to applicant, issued Apr. 18, 1989 disclose heat exchangers used for cooling the oil in an automotive engine. The oil coolers generally include a tank having a hot fluid inlet and outlet and integral cap members closing each end of the tank and providing a cooling fluid inlet and outlet. The hot fluid and cooling fluid inlets and outlets are connected to corresponding rigid couplers on the engine housing. The cap members are fixedly connected to the ends of the tank, such as by a weld, to prevent relative movement therebetween. As can be appreciated, a slight offset in the orientation angle of the cap inlet and outlet in relation to the tank inlet and outlet would make for difficult assembly to the engine housing. Upon connection to the housing, the offset in the orientation angle could cause stress and fatigue to the oil cooler and/or engine housing and result in failure of the oil cooler.

Various methods have been employed to provide a rotational connection between the tank and the cap members to allow for adjustment of the orientation angle between the hot fluid inlet and outlet and the cooling fluid inlet and outlet. Many of these methods include tabs extending radially from a male member received in channels disposed axially within a female member. The tabs are further rotated in an annular groove of the female member thus locking the two members together.

U.S. Pat. No. 788,200 to Finch, issued Apr. 25, 1905, discloses a connection between a pipe section and a tubular sleeve for ordinary heating-stoves. The tubular sleeve comprises an interior annular groove and a plurality of interior longitudinal channels intersecting at their inner ends with the annular groove. The pipe section comprises exterior tabs corresponding to the longitudinal channels. The tabs are received in the channels and rotated into the annular groove to lock the pipe section and tubular sleeve together.

The U.S. Pat. No. 4,379,574 to Leichtl, issued Apr. 12, 1983, discloses a heat exchanger assembly, such as a radiator, including a filler spout extending from an opening in the assembly. The opening is formed with an inwardly extending skirt having a plurality of cam/lock sections. Each section comprises a receiving end, a leading surface, and a locking recess, defined by a stop. The opening includes a plurality of radial slots extending radially of the skirt and adjacent the receiving end of the cam surfaces. The opening further includes an annular sealing recess for receiving a seal. The spout comprises an upper portion having a radially extending shoulder and a lower portion having a plurality of radially extending tabs. The spout is inserted into the opening by passing the tabs through the slots. The tabs are received by the receiving end of the cam surface and as the spout is rotated in a counterclockwise direction, the tabs move along the cam surface until they snap into the locking recess and abut against the stop. The seal is compressed between the shoulder of the spout and the sealing recess in the opening to provide a fluid impervious connection.

U.S. Pat. No. 2,811,337 to Andersen, issued Oct. 29, 1957, discloses a heat exchanger comprising a shell having a first and second end defined by a flaring portion formed integral with a body portion of the tank. A first O-ring provides a seal between the flaring portion and a header within the tank. The assembly further includes caps connected to the ends of the tank and having inlet and outlet conduits. The caps include a rim having an annular flange and a shoulder. The flange abuts against the first O-ring to provide a seal between the body and cap and the shoulder abuts against the header to prevent axial movement of the cap. A retainer ring is seated in the flaring portion to connect the cap to the body of the tank and further prevent axial movement therebetween. A second O-ring provides a seal between the caps and the flaring portion.

U.S. Pat. No. 2,956,704 to Boni, Jr., issued Oct. 18, 1960, discloses a heat exchanger welded to a head barrel wall and including a tube inlet, tube outlet and head chamber. A tube sheet is positioned in the head chamber between the heat exchanger and the head barrel wall. A tube pass housing member is connected to a portion of the tube sheet and comprises an outlet elbow coupled to the tube outlet. The housing member and tube sheet are fixedly secured to the head barrel wall within the head chamber by a locking ring. The locking ring includes a bayonet type connection by including lugs engaging corresponding lugs on the barrel wall. A sealing ring is positioned between the tube sheet and the locking ring and compression screws engage the seal and compress it against the tube sheet and further lock the lugs together. The connection between the locking ring and the head barrel wall, however, does not allow for rotation of the locking ring relative to the tube sheet.

It remains desirable to provide a rotatable connection between an end cap and a tank of a heat exchanger, such that, the connection maintains a fluid impervious seal between the cap and the tank, yet allows rotation between the cap and the tank for orientation of the hot fluid inlet and outlet relative to the cooling fluid inlet and outlet. Further, such a connection is desirable to relax the tolerances required in manufacturing the heat exchanger and to reduce the effort in disassembling and repairing the heat exchanger. Further, such a connection is desirable to increase the heat transfer characteristics in the heat exchanger by using the cap members as fluid reservoirs to increase the capacity of fluid flow and heat transfer.

SUMMARY OF THE INVENTION AND ADVANTAGES

In accordance with the present invention, there is provided a heat exchanger assembly comprising tank means having a longitudinal axis extending between a first and second end for conveying fluid therethrough, heat exchanger means disposed in the tank means for removing heat energy from the fluid, attachment means fixed to the tank means in a predetermined position extending radially from the longitudinal axis for attaching the tank means to a vehicle, and cap means for closing at least one of the first and second ends. The cap means includes a coupler for connection to a fluid conduit. The assembly is characterized by including connection means interconnecting the cap means and one end of the tank means for maintaining a fluid impervious seal between the cap means and the one end of the tank means and for allowing relative rotation between the cap means and the tank means to annularly adjust the position of the coupler with the fluid conduit. The assembly is further characterized by the connection means including a male member having at least two tabs spaced circumferentially apart a predetermined arcuate distance about the axis and a female member having an interior annular channel intersecting with at least two axially extending interior passageways disposed parallel to one another and spaced circumferentially the predetermined distance for receiving the tabs of the male member. The male member further includes an annular rim and the female member includes at least a portion of an annular wall. A resilient sealing means is compressed between the rim and the wall for locking the tabs in the annular channel while establishing a fluid impervious seal therebetween and for allowing relative rotation between the cap means and the tank means.

FIGURES IN THE DRAWINGS

Other advantages of the present invention will be readily appreciated as the same becomes better understood by reference to the following detailed description when considered in connection with the accompanying drawings wherein.

DETAILED DESCRIPTION OF THE DRAWINGS

Figure 1:
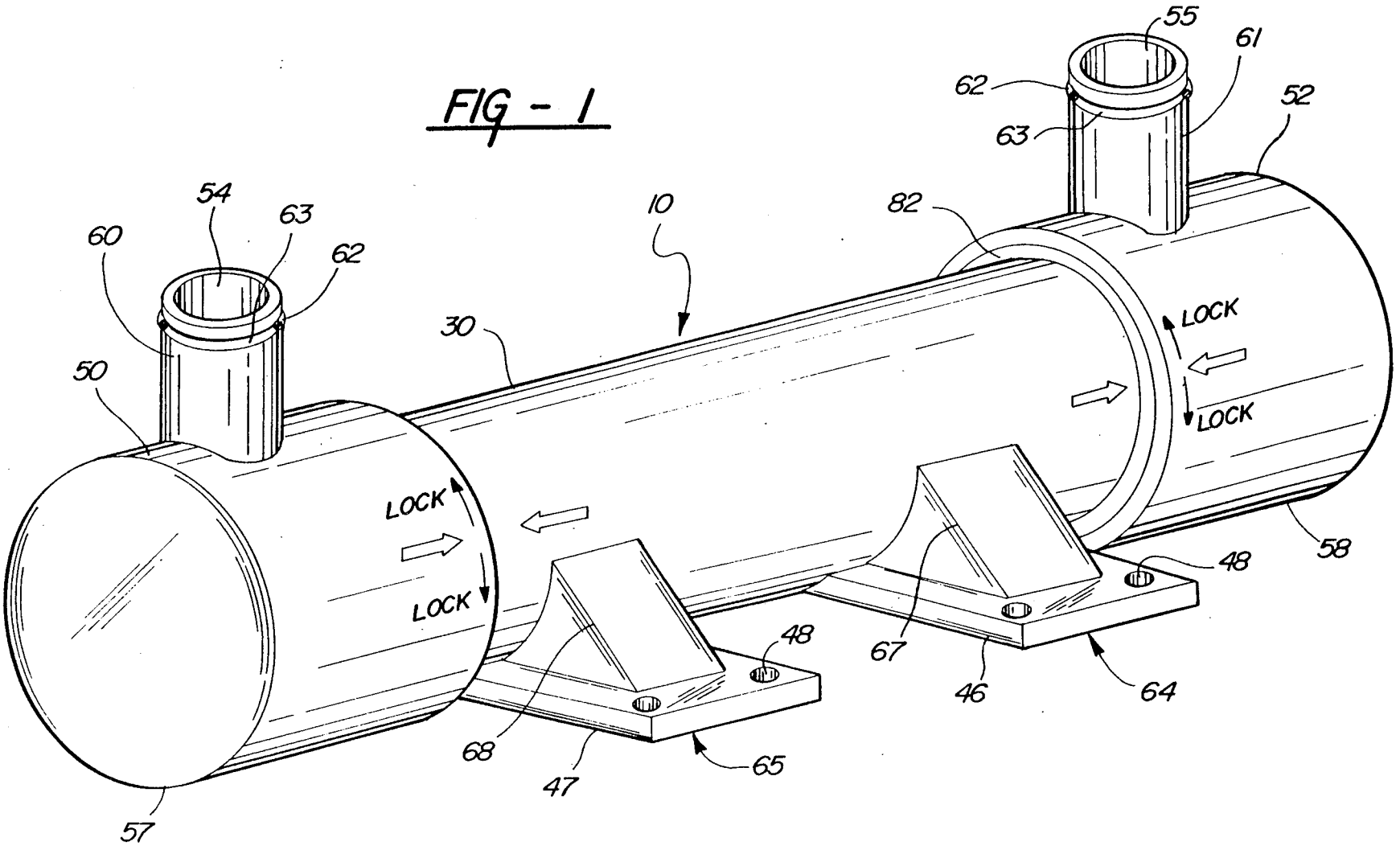
FIG. 1 is a perspective view of an assembly made in accordance with the present invention.
Figure 2:
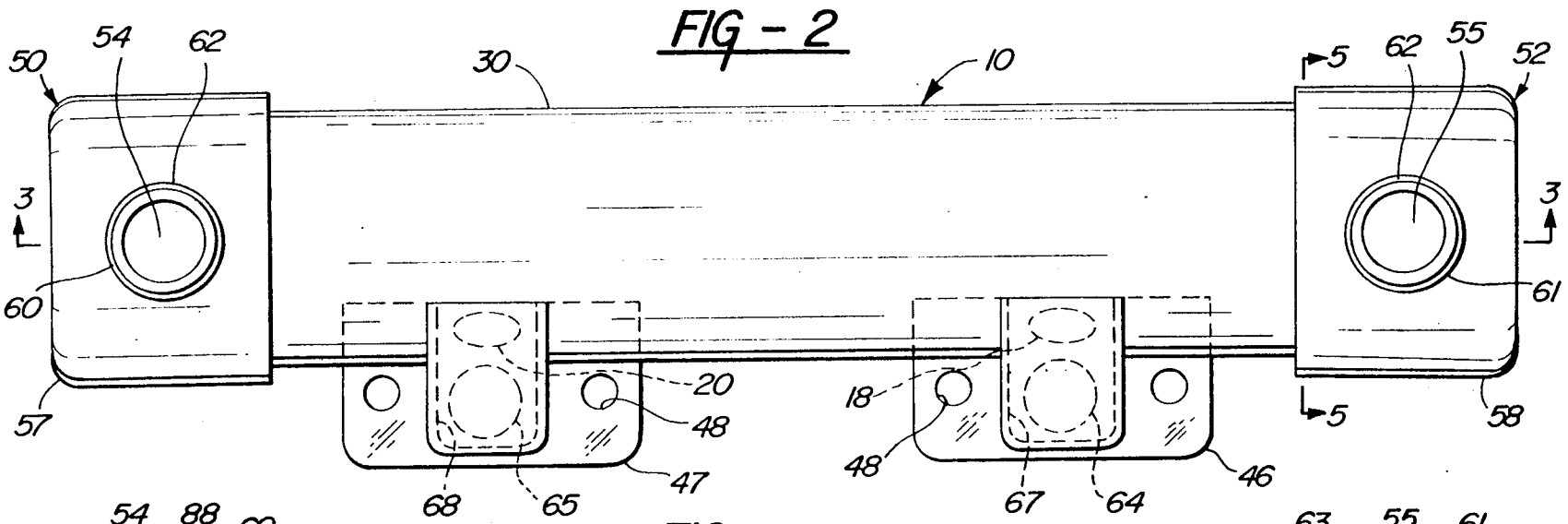
FIG. 2 is a top view of the assembly of FIG. 1.
Figure 3:
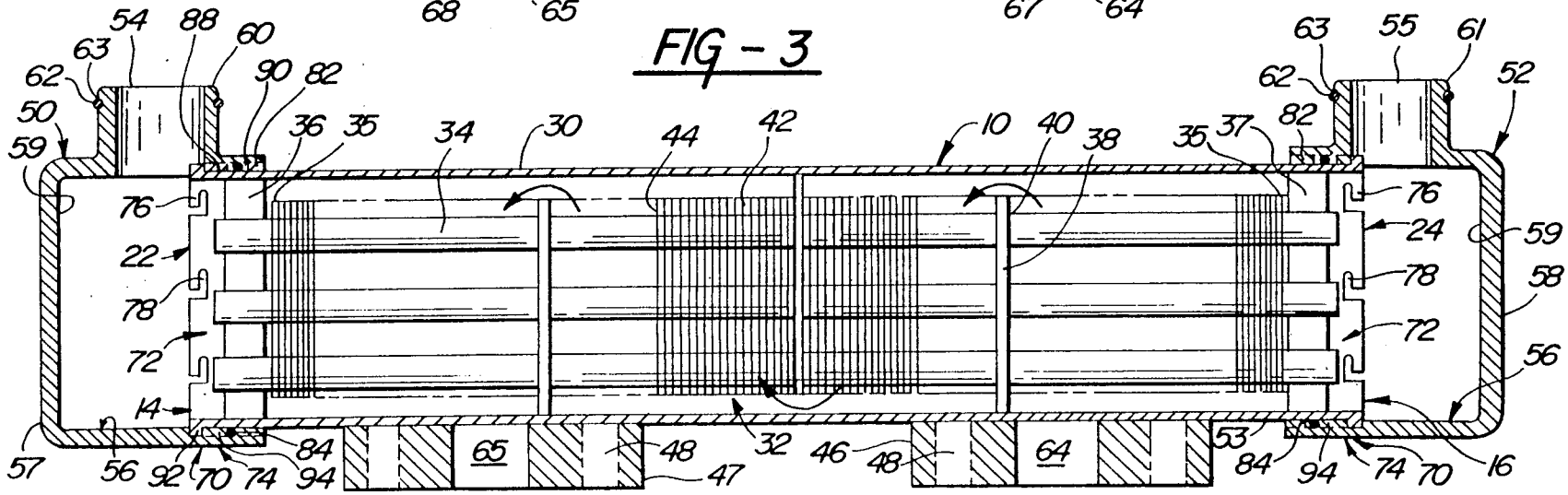
FIG. 3 is a cross-sectional view taken substantially along lines 3—3 of FIG. 2.

Referring to the Figures wherein like numerals indicate like or corresponding parts throughout the several views, a heat exchanger assembly of the shell and tube type is shown as including a tank means generally indicated at 10. As shown in FIGS. 1-3, the tank means 10, generally cylindrical or tubular in shape, includes a longitudinal axis between first 14 and second 16 ends. The tank means 10 includes a tank hot fluid inlet 18 and a tank hot fluid outlet 20 extending radially outwardly of the tank means 10, and a tank cooling fluid inlet 22 and tank cooling fluid outlet 24 extending parallel with the longitudinal axis at each end 14, 16 of the tank means 10. The tank means 10 further defines a hot fluid reservoir 30 disposed between the first 14 and second 16 ends. As shown in FIGS. 2 and 3, the hot fluid and cooling fluid are shown in a counterflow direction, that is, the hot fluid passes through the tank means 10 in the opposite direction of the cooling fluid. It will b appreciated that the tank hot fluid inlet 18 and tank hot fluid outlet 20 may be reversed such that the hot fluid flows in the same direction as the cooling fluid.

A heat exchanger means, generally shown at 32, is disposed within the tank means 10 and includes a plurality of cylindrical tubes 34 disposed parallel to the longitudinal axis within the tank means 10 and extending between first 14 and second 16 ends. A header 36, being disk-like and having a diameter equal to that of the inside diameter of the tank means 10, supports one end of the tubes 34 at the first end 14 of the tank means 10 and provides a fluid impervious barrier between the tank cooling fluid inlet 22 and the hot fluid reservoir 30. Likewise, a header 37 supports the opposite end of the tubes 34 at the second end 16 of the tank means 10 and provides a fluid impervious barrier between the tank cooling fluid outlet 24 and the hot fluid reservoir 30. The headers 36, 37 are sealed to the inner surface of the tube by welding, soldering or with an O-ring, to provide such a fluid impervious seal. The ends of the tubes 34 extend through openings 35 in the headers 36, 37 so that the cooling fluid may pass through the tank inlet 22, enter the tubes 34, and exit the tank outlet 24 without being exposed to the hot fluid flow in the reservoir 30. The ends of the tubes 34 are likewise sealed, by welding, soldering or with an O-ring, within the headers 36, 37 to provide a fluid impervious seal therebetween. The heat exchanger means 32 further includes a plurality of baffles 38 spaced between the headers 36, 37 for directing the hot fluid flow throughout the hot fluid reservoir 30. The tubes 34 pass through openings 40 within the baffles 38. The baffles 38 extend outwardly from the inner surface of the tank means 10 at alternating sides thereof and are of less diameter than the inside diameter of the tank means 10 to allow a directional pathway for the hot fluid flow indicated by the directional arrows as shown in FIG. 3. The baffles 38 create a multi-pass flow of the hot fluid about the tubes 34 of the cooling fluid, the number of passes varying according to the number of baffles 38. The heat exchanger means 32 further includes a plurality of fins 42 having a plurality of openings 44 therethrough for passage of the tubes 34. The fins 42 are spaced closely together throughout the tank means 10 for disbursing the hot fluid extensively about the tubes 34. The fins 42 are further discussed in Applicants U.S. Pat. No. 4,821,795, issued Apr. 18, 1989.

Figure 6:
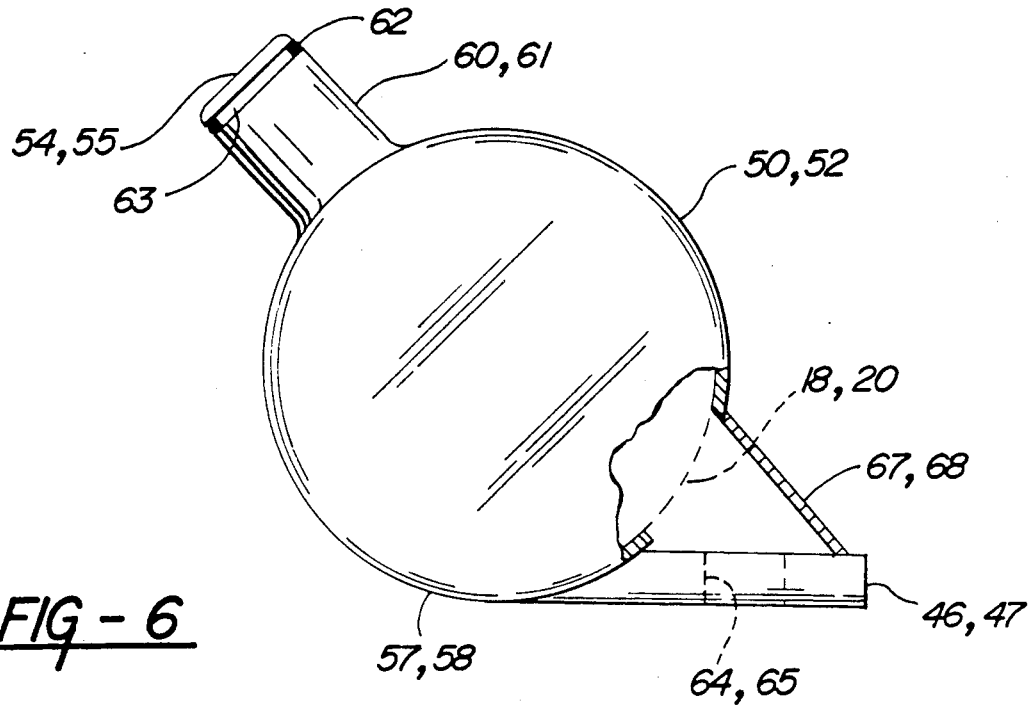
FIG. 6 is a cross-sectional view taken substantially along lines 6—6 of FIG. 2.

Attachment means 46, 47 extend radially outwardly from the tank means 10, each at a predetermined fixed position axially along the tank 10, for securing the assembly to a vehicle. The attachment means 46, 47 are generally rectangular in cross-section and extend outwardly and perpendicular to the longitudinal axis from the bottom portion of the tank means 10 as shown in FIGS. 1 and 6. The attachment means 46, 47 include a plurality of apertures 48 therethrough for receiving a fastening member (not shown) upon connection to a vehicle. The attachment means 46, 47 further include, as shown in FIGS. 2 and 6, an attachment hot fluid inlet 64 in fluid communication with the tank hot fluid inlet 18, and an attachment hot fluid outlet 65 in fluid communication with the tank hot fluid outlet 20. The attachment means 46, 47 further include, as shown in FIGS. 1, 2 and 6, duct means 67, 68 disposed about and defining the hot fluid inlets 18, 64 and hot fluid outlets 20, 65. The duct means 67, 68 extend radially outwardly from the tank means 10 to the top surface of the attachment means 46, 47 in the fashion of a gusset. The duct means 67, 68 create a wall or channel about the attachment hot fluid inlet 64 and attachment hot fluid outlet 65 and the tank hot fluid inlet 18 and tank hot fluid outlet 20 respectively. The duct means 67, 68 further create a passageway for providing fluid communication between the hot fluid inlets 18, 64 and hot fluid outlets 20, 65.

Figure 4:
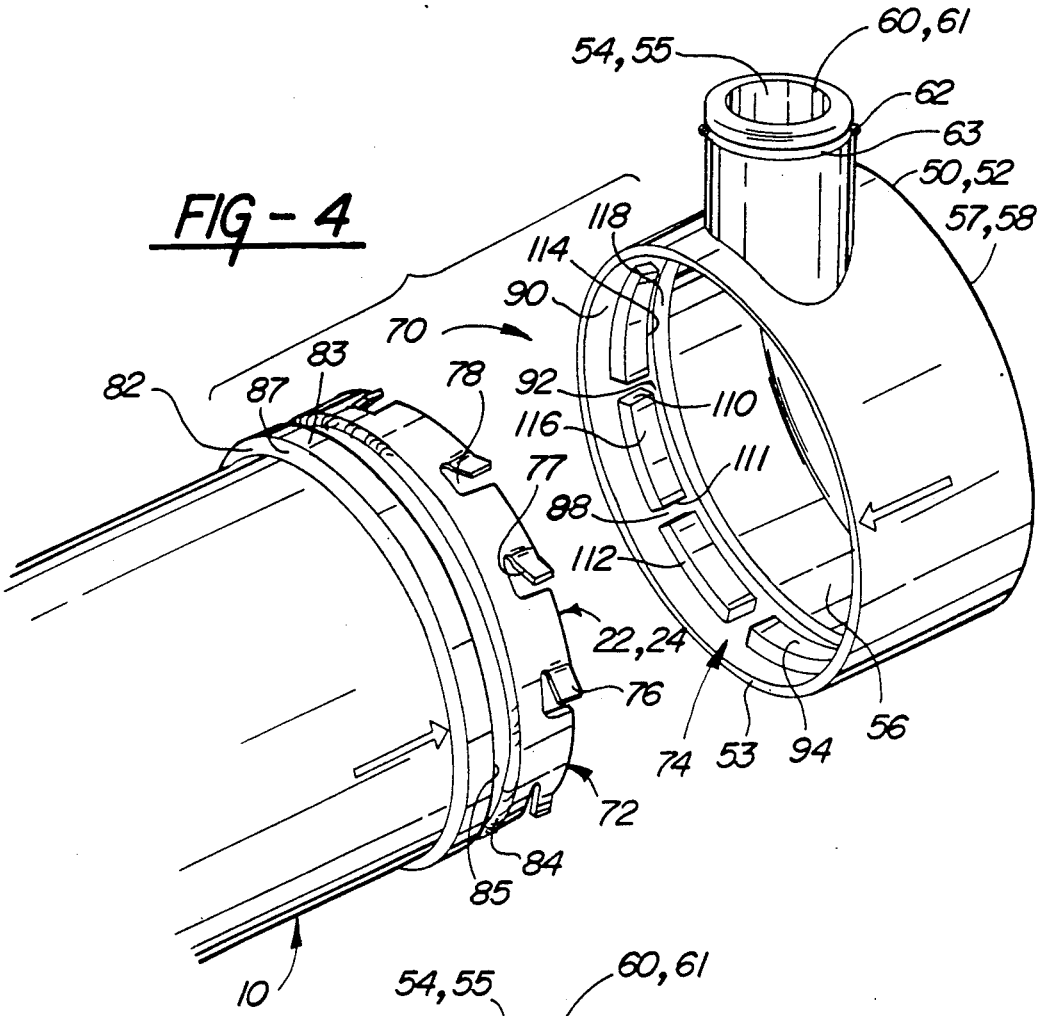
FIG. 4 is an exploded perspective view of the cap means and tank means of FIG. 1.
Figure 5:
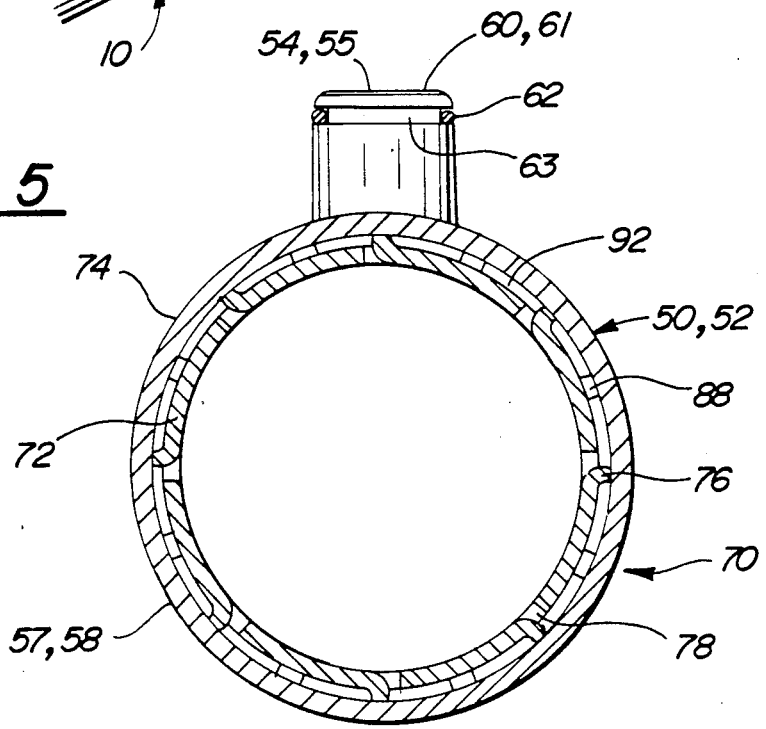
FIG. 5 is a cross-sectional view taken substantially along line 5—5 of FIG. 2.

Cap means 50, 52, as shown in FIG. 4, are generally cylindrical in cross-section in a plane taken perpendicular to the longitudinal axis and include an opening 53, an annular inner surface 56, and a back wall 59. The cap means 50, 52 include hollow cylindrical couplers 60, 61 extending radially outwardly and perpendicular to the longitudinal axis. It will be appreciated that the couplers 60, 61 may extend from the cap means 50, 52 at any angle relative to the longitudinal axis. Further, the couplers 60, 61 may be positioned parallel to the longitudinal axis. The location of the couplers 60, 61 as shown is merely for illustration and may be positioned at any location about the cap means 50, 52. The couplers 60, 61 comprise an annular resilient sealing means 62, such as an O-ring, positioned in an annular groove 63 at the upper portion of the coupler 60, 61 for connection to a fluid conduit 102, 103. The cap means 50 includes a cap cooling fluid inlet 54 extending through the coupler 60 and in fluid communication with the tank cooling fluid inlet 22 and the cap means 52 includes a cap cooling fluid outlet 55 extending through the coupler 61 and in fluid communication with the tank cooling fluid outlet 24. The cap means 50 further includes a cooling fluid inlet reservoir 57 disposed between the cap inlet 54 and the tank inlet 22 and, likewise, the cap means 52 further includes a cooling fluid outlet reservoir 58 disposed between the cap outlet 55 and tank outlet 24. The cooling fluid reservoirs 57, 58 may further be defined by being bounded by the opening 53 in the cap means 50, 52, the inner surface 56, and the back wall 59.

The subject invention is characterized by including connection means 70 for interconnecting the cap means 50, 52 with the first 14 and second 16 ends of the tank means 10. Each connection means 70 includes a male member 72 being an integral extension of the tank means 10, and a female member 74 being integral with and disposed within the cap means 50, 52. The male member 72 includes a plurality of outwardly extending tabs 76 spaced circumferentially at a predetermined arcuate distance apart from the longitudinal axis. The tabs 76 are generally rectangular in cross-section in a plane taken parallel to the longitudinal axis, and generally L-shaped in cross-section in a plane taken perpendicular to the axis. Viewing the tabs 76 from a side view, as shown in FIG. 3, the tabs 76 may be further defined by having an L-shaped slot 78 extending therearound. The tabs 76 further include a bearing surface 77 which will be further described below. The male member 72 further comprises a radially extending annular rim 82 spaced longitudinally from the tabs 76 and integral with the tank means 10. The annular rim 82 comprises a top surface 83, a front bearing surface 85, and a rear surface 87. A resilient annular sealing means 84, such as an O-ring, is further disposed about the male member 72 positioned between the tabs 76 and the annular rim 82. The rim 82 is generally rectangular in cross section, thus providing a wall or barrier for the sealing means 84.

The female member 74, as shown in FIG. 4, includes a plurality of axially extending interior passageways 88 disposed parallel to one another and further spaced circumferentially a predetermined arcuate distance coinciding with that of the tabs 76. The female member 74 includes a first 90 and second 92 interior annular channel. The channels 90, 92 are spaced longitudinally apart and intersect with opposite ends of the passageways 88. The first channel 90 further extends to the opening 53 of the cap member 50, 52 forming a receiving flange. The female member 74 further comprises a plurality of arcuate islands 94 spaced about the interior surface 56 of the cap means 50, 52 and further bounded by the first 90 and second 92 channels and the interior passageways 88. The arcuate islands 94 are generally rectangular in cross-section and provide at least a portion of an annular wall 94. The arcuate islands 94 include side walls 110, 111, a front arcuate bearing surface 112, a rear arcuate bearing surface 114 and a top surface 116. The annular wall 94 is composed of the arcuate islands 94 positioned circumferentially about the inner surface of the flange of cap means 50, 52 and spaced apart by the passageways 88 thus, interrupting the annular wall 94. Similarly, an annular wall 118 is formed between the interior annular channel 92 and the inner surface 56 of the cap means 50, 52.

Figure 8:
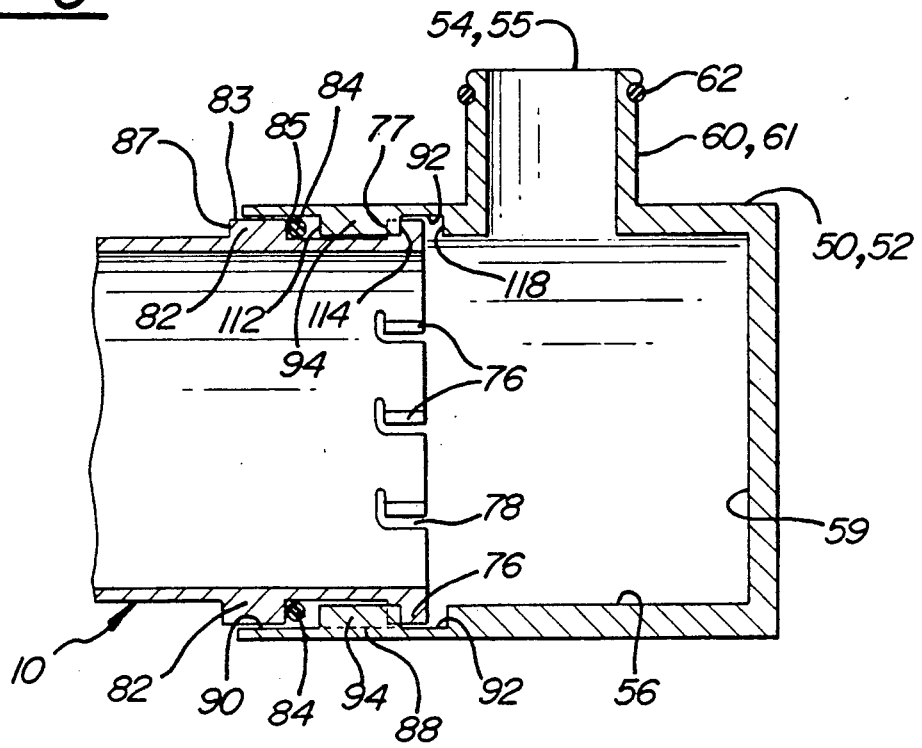
FIG. 8 is an enlarged fragmentary view of the connection means of FIG. 3 prior to connection.
Figure 9:
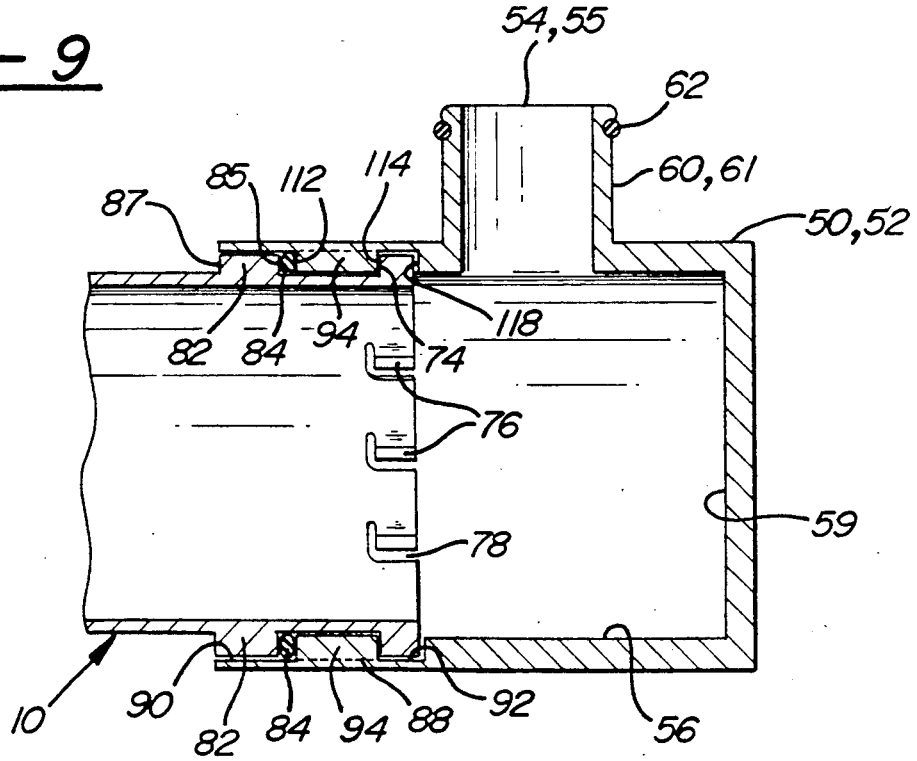
FIG. 9 is an enlarged fragmentary view of the connection means of FIG. 3 after connection.

In assembly, as best shown in FIGS. 4, 5, 8 and 9, the tank means 10 and cap means 50, 52 are orientated by aligning the markings or arrows on each corresponding exterior surface. In this position, as the cap means 50, 52 is disposed about the exterior end 14, 16 of the tank means 10, the tabs 76 of the male member 72 will align with corresponding passageways 88 of the female member 74. The cap means 50, 52 is continued axially along the longitudinal axis about the end 14, 16 of the tank means 10 until the resilient sealing means 84 abuts between the front bearing surface 85 of the annular rim 82 and the plurality of arcuate bearing surfaces 112 of the islands 94. As shown in FIG. 8, the tabs 76 are still positioned partially in the passageways 88 and partially extending or intersecting with the second interior annular channel 92. The cap means 50, 52 is further continued axially along the tank means 10, compressing the resilient sealing means 84 between the rim 82 and islands or wall 94. The compression of the sealing means 84 further allows the tabs to extend completely into the channel 92, passing beyond the rear surface 114 of the islands 94. The cap means 50, 52 is then rotated in either a clockwise or counterclockwise direction to move the tabs 76 out of the passageways 88 and lock the cap means 50, 52 and tank means 10 together as shown in FIG. 9.

In the locked position, the resilient sealing means 84 establishes a bias force of the tabs 76 against the rear bearing surface 114 of the islands 94. Furthermore, the resilient sealing means 84 limits or restrains axial movement of the cap means 50, 52 relative to the tank means 10 by maintaining the tabs 76 in abutment with the islands 94 and further restraining separation therefrom.

The cap means 50, 52 are free to rotate about the tank means 10 for orientation of the conduits 60, 61 with corresponding conduits 102, 103. Similarly, the tank means 10 may be rotated to align the hot fluid inlet 64 and outlet 65 with corresponding conduits 104, 105. The rotatable connection between the tank means 10 and the cap means 50, 52 is provided by the interaction of the smooth arcuate bearing surfaces 85, 112 against the sealing means 84 and further by the bearing surfaces 114 of the islands 94 against the bearing surfaces 77 of the tabs 76. It is important that the bearing surfaces 112, 114 of the islands form at least a portion of an arcuate wall 94, or alternatively a complete annular wall 118, so that the sealing means 84 and tabs 76 rotate on smooth bearing surfaces for minimum friction wear and drag and maximum sealing and rotation.

It will further be appreciated that the sealing means 84 could provide a fluid impervious seal by being positioned in the channel 92 and compressed between the end 14, 16 of the tank means 10 and the annular wall 118 formed by the channel 9 and inner surface 56. Thus, the annular wall 94 could include the plurality of arcuate islands 94 separated by passageways 88 or the annular wall 118.

Figure 7:
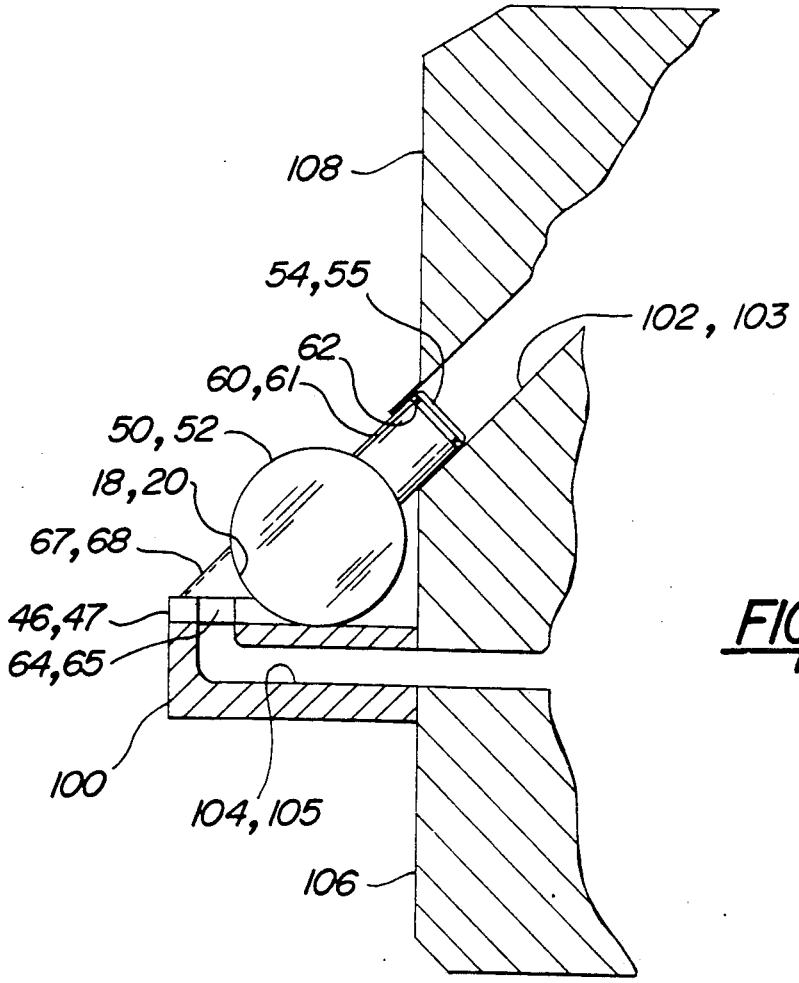
FIG. 7 is an end view of the assembly of FIG. 1 shown in connection with an engine housing.

The assembly is commonly used as an oil cooler operating with a vehicle engine block 106 as shown in FIG. 7. The engine block comprising an engine housing 108 having hot fluid inlet and outlet lines 104, 105 and cooling fluid inlet and outlet conduits 102, 103. The hot fluid lines 104, 105 extend from the engine housing 108 through a mounting base 100. The engine housing 108 and mounting base 100 are rigid thus forming a fixed angle between the hot fluid inlet and outlet lines 104, 105 and the cooling fluid inlet and outlet conduits 102, 103. In connection, the cap means 50, 52 on each end 14, 16 of the tank means 10 are rotated, aligned and positioned into the fixed cooling fluid inlet and outlet conduits respectively. The resilient sealing means 62 provides a fluid impervious barrier therebetween. The connection means 70 between the cap means 50, 52 and tank means 10 allows for rotation of the tank means 10 about the longitudinal axis to align the attachment means 46, 47 with the mounting base 100 and likewise the hot fluid inlet 64 and outlet 65 with the fixed hot fluid inlet and outlet lines 104, 105 respectively. The attachment means 46, 47 are fixedly secured to the mounting base 100 by placing fasteners (not shown) through the apertures 48. A sealing gasket (not shown) is seated between the attachment means 46, 47 and the mounting base to provide a fluid seal therebetween. It will be noted the alignment between the flat bottom surface of the attachment means 46, 47 and the mounting base 100 requires extreme accuracy to perfect a fluid seal due to the rigidity of the two members. Thus, the rotational capability provided by the connection means 70 eliminates the need to manufacture the oil cooler assembly with great accuracy, causing great expense. Any inaccuracies may be compensated for by the rotation and alignment of the cap means 50, 52 and/or tank means 10. The connection means 20 further provides facile field service without complete disassembly.

In operation, the assembly acts as a heat exchanger for cooling hot fluid, such as oil, as it circulates through the tank means 10 about the tubes 34 of cooling fluid. Hot oil may be pumped through the hot fluid line 104, enter the assembly by way of the attachment hot fluid inlet 64, pass through the duct means 67 and through the tank hot fluid inlet 18 to enter the hot fluid reservoir 30. The hot fluid flows about the tubes 34 being directed through the reservoir 30 by the baffles 38 and dispersed about the tubes 34 by the fins 42. The hot fluid exits the tank means 10 at the tank hot fluid outlet 20 passing through the duct means 68 and attachment hot fluid outlet 65 and through the hot fluid line 104 to recirculate throughout the engine housing 108. Simultaneously, the cooling fluid flows from the fluid conduit 102, enters the cap cooling fluid inlet 54, flows through the coupler 60, fills the cooling fluid inlet reservoir 57, and proceeds into the tank means 10 by way of the tank cooling fluid inlet 22. The cooling fluid then enters the end of the tubes 34 at the first end 14 of the tank means 10, travels along the longitudinal axis to the second end 16 of the tank means 10, and exits the tank means 10 by way of the tank cooling fluid outlet 24. The cooling fluid then fills the cooling fluid outlet reservoir 58, flows through the coupler 61 and exits through the cap cooling fluid outlet 55 and into the fluid conduit 103 to recirculate through a cooling unit 108.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims wherein reference numerals are merely for convenience and are not to be in any way limiting, the invention may be practiced otherwise than as specifically described.

What is claimed is:

1. A heat exchanger assembly comprising:

tank means (10) having a longitudinal axis extending between first (14) and second (16) ends for conveying fluid therethrough, heat exchanger means (32) disposed in said tank means (10) for removing heat energy from the fluid, attachment means (46, 47) fixed to said tank means (10) at a predetermined position extending radially from said axis for attaching said tank means (10) to a vehicle, cap means (50, 52) for closing at least one of said first (14) and second (16) ends and including a coupler (60, 61) for connection to a fluid conduit (102, 103); said assembly characterized by including connection means (70) interconnecting said cap means (50, 52) and said one end (14, 16) of said tank means (10) for maintaining a fluid impervious seal between said cap means (50, 52) and said one end (14, 16) and for allowing relative rotation between said cap means (50, 52) and said tank means (10) to annularly adjust the position of said coupler (60, 61) with said fluid conduit (102, 103), said connection means (70) including a male member (72) having at least two tabs (76) spaced circumferentially apart a predetermined arcuate distance about said axis and a female member (74) having an interior annular channel (92) intersecting with at least two axially extending interior passageways (88) disposed parallel to one another and spaced circumferentially said predetermined distance for receiving said tabs (76) of said male member (72), said male member (72) further including an annular rim (82) and said female member (74) including at least a portion of an annular wall (94, 118) and said connection means (70) including resilient sealing means (84) compressed between said rim (82) and said wall (94, 118) for locking said tabs (76) in said annular channel (92) while establishing a fluid impervious seal therebetween and for allowing relative rotation between said cap means (50, 52) and said tank means (10).

2. An assembly as set forth in claim 1 further characterized by said female member (74) having first (90) and second (92) interior annular and longitudinally spaced channels intersecting with opposite ends of said passageways (88) to thereby form a plurality of spaced islands (94) bounded by said first (90) and second (92) channels and said passageways (88).

3. An assembly as set forth in claim 2 further characterized by said islands (94) forming said portions of an annular wall (94) continuing about the interior circumference of said female member (74) said portions (94) being interrupted by said axial passageways (88).

4. An assembly as set forth in claim 3 further characterized by said tabs (76) being an integral extension of said male member (72) and each tab (76) having a generally L-shaped cross-section in a plane taken perpendicular to said longitudinal axis.

5. An assembly as set forth in claim 6 further characterized by said male member (72) including an L-shaped slot (78) extending about each of said tabs (76).

6. An assembly as set forth in claim 5 further characterized by said annular rim (82) extending radially from said male member (72) and spaced longitudinally from said tabs (76) and said resilient annular sealing means (84) disposed between said rim (82) and said islands (94).

7. An assembly as set forth in claim 6 further characterized by said male member (72) being integral with and extending from said tank means (10) and said female member (74) being integral with and disposed within said cap means (50, 52).

8. An assembly as set forth in claim 7 further characterized by said coupler (60, 61) being generally cylindrical and having resilient sealing means (62) for providing a fluid impervious seal between said coupler (60, 61) and the fluid conduit (102).

9. An assembly as set forth in claim 8 further characterized by said tank means (10) being generally cylindrical and having a tank hot fluid inlet (18), a tank hot fluid outlet (20), a tank cooling fluid inlet (22), a tank cooling fluid outlet (24), and a hot fluid reservoir (30) disposed between said first (14) and second (16) ends.

10. An assembly as set forth in claim 9 further characterized by said heat exchanger means (32) including a plurality of generally cylindrical tubes (34) parallel to said longitudinal axis, said tubes (34) being disposed in said tank means (10) and extending between said first (14) and second (16) end.

11. An assembly as set forth in claim 10 further characterized by said heat exchanger means (32) further including cylindrical headers (36, 37) for support of each end of said tubes (34) and for providing a fluid impervious barrier between said hot fluid reservoir (30) and said tank cooling fluid inlet (22) and said tank cooling fluid outlet (24).

12. An assembly as set forth in claim 11 further characterized by said heat exchanger means (32) further including a plurality of baffles (38) for directing the flow of fluid about said tubes (34), said baffles (38) having a plurality of openings (40) therethrough for passage of said tubes (34).

13. An assembly as set forth in claim 12 further characterized by said heat exchanger means (32) further including a plurality of fins (42) for dispersing the fluid about said tubes (34), said fins (42) having a plurality of openings (44) therethrough for passage of said tubes (34).

14. An assembly as set forth in claim 13 further characterized by said cap means (50, 52) further including a cap cooling fluid inlet (54) and cap cooling fluid outlet (55) in fluid communication with said tank cooling fluid inlet (22) and said tank cooling fluid outlet (24) respectively.

15. An assembly as set forth in claim 14 further characterized by said cap means (50, 52) further including a cooling fluid inlet reservoir (57) disposed between said cap cooling fluid inlet (54) and said tank cooling fluid inlet (22) and a cooling fluid outlet reservoir (58) disposed between said cap cooling fluid outlet (55) and said tank cooling fluid outlet (24).

16. An assembly as set forth in claim 15 further characterized by said attachment means (46, 47) generally rectangular in shape and extending radially from said tank means (10) and including a plurality of apertures (48) therethrough for attachment to the vehicle.

17. An assembly as set forth in claim 16 further characterized by said attachment means (46, 47) further including an attachment hot fluid inlet (64) and an attachment hot fluid outlet (64) in fluid communication with said tank hot fluid inlet (18) and said tank hot fluid outlet (20) respectively.

18. An assembly as set forth in claim 17 further characterized by said attachment means (46, 47) further including duct means (67, 68) disposed about said attachment hot fluid inlet (64) and tank hot fluid inlet (18) and further disposed about said attachment hot fluid outlet (65) and said tank hot fluid outlet (20) for providing a fluid passageway between said inlets (18, 64) and said outlets (20, 65).

19. A heat exchanger assembly of the tube-fin type comprising:

a tank (10) having a longitudinal axis extending between first (14) and second (16) ends and including a tank hot fluid inlet (18), a tank hot fluid outlet (20), a tank cooling fluid inlet (22), a tank cooling fluid outlet (24) and a hot fluid reservoir (30);

a heat exchanger (32) disposed in the tank (10) including a plurality of tubes (34) supported at each end by cylindrical headers (36, 37), a plurality of baffles (38) spaced longitudinally in the tank (10) and a plurality of fins (42) spaced closely within the tank (10);

a cap (50, 52) disposed about each end (14, 16) of the tank (10) including a coupler (60, 61) extending radially from the longitudinal axis and having a seal (62) disposed thereabout;

the cap (50) further including a cap cooling fluid inlet (54) and a cooling fluid inlet reservoir (57) and the cap (52) further including a cap cooling fluid outlet (55) and a cooling fluid outlet reservoir (58);

a connection (70) between each cap (50, 52) and each end (14, 16) of the tank (10) including a plurality of longitudinal passageways (88) disposed within the cap (50, 52), a first (90) and second (92) annular channel intersecting with opposite ends of the passageways (88), a plurality of arcuate island (94) bounded by the intersection of the first (90 and second (92) channel and the passageways (88), a plurality of radially extending tabs (76) received in the passageways (88) and further rotated into the second channel (92), the tabs (76) further defined by having an L-shaped slot (78) formed thereabout, an annular extending rim (82) spaced longitudinally from the tabs (76), and a resilient annular seal (84) disposed between the rim (82) and the arcuate islands (94); and a plurality of attachments (46, 47) extending radially of the longitudinal axis and having a plurality of apertures (48) therethrough for connection to a vehicle;

the attachment (46) further including an attachment hot fluid inlet (64) in fluid communication with the tank hot fluid inlet (18) and having a duct (67) disposed thereabout for providing a fluid passageway therebetween;

the attachment (47) further including an attachment hot fluid outlet (65) in fluid communication with the tank hot fluid outlet (20) and having a duct (68) disposed thereabout for providing a fluid passageway therebetween.

* * * * *